US006065155A

United States Patent [19]

Sandusky

[11] Patent Number: 6,065,155

[45] **Date of Patent: *May 23, 2000**

[54] GLOVE FOR USE IN FOOTBALL AND SIMILAR GAMES

[76] Inventor: James D. Sandusky, 6190 Tyler La., Ferndale, Wash. 98248

[ * ] Notice: This patent issued on a continued prosecution application filed under 37 CFR 1.53(d), and is subject to the twenty year patent term provisions of 35 U.S.C. 154(a)(2).

[21] Appl. No.: 09/085,531

[22] Filed: May 27, 1998

[51] Int. Cl.[7] ..... A41D 19/00

[52] U.S. Cl. ..... 2/161.1; 2/161.3; 2/161.4; 2/167

[58] Field of Search ..... 2/159, 158, 161.1, 2/161.2, 161.3, 161.4, 161.8, 167, 16, 20, 163, 161.5

[56] References Cited

U.S. PATENT DOCUMENTS

| | | | |
|---|---|---|---|
| 1,179,871 | 4/1916 | St. John . | |
| 1,346,683 | 7/1920 | Reynolds . | |
| 3,881,197 | 5/1975 | Andrews | 2/161.1 |
| 4,089,069 | 5/1978 | Vistins | 2/161.1 |
| 4,359,783 | 11/1982 | Andrews . | |
| 4,525,877 | 7/1985 | Chong | 2/161.1 |
| 4,598,429 | 7/1986 | Mulvaney . | |
| 5,117,509 | 6/1992 | Bowers | 2/161.1 |
| 5,164,231 | 11/1992 | Davis . | |
| 5,316,294 | 5/1994 | Turangan | 2/159 |
| 5,500,956 | 3/1996 | Schulkin et al. . | |
| 5,511,248 | 4/1996 | Widdemer . | |
| 5,682,613 | 11/1997 | Dinatale | 2/161.5 |
| 5,708,979 | 1/1998 | Redwood | 2/161.1 |

FOREIGN PATENT DOCUMENTS

| | | |
|---|---|---|
| 4-361602 | 12/1992 | Japan . |
| 6-101105 | 4/1994 | Japan . |

*Primary Examiner*—John J. Calvert
*Assistant Examiner*—Tejash Patel
*Attorney, Agent, or Firm*—Jensen & Puntigam, P.S.

[57] ABSTRACT

The glove includes a glove body having first and second regions, the first region including approximately the front half of the glove including the front half of all the fingers and all of the thumb region, the first region having a rubber-like softened PVC surface layer which is waterproof and otherwise has characteristics to improve the catching of a football. The second region, which comprises the rear half of the glove, except for the thumb, is made from a material which is stretchable and breathable. A tightening strap is provided at the lower end of the glove on the second region thereof.

7 Claims, 3 Drawing Sheets

GLOVE FOR USE IN FOOTBALL AND SIMILAR GAMES

TECHNICAL FIELD

This invention relates generally to sporting gloves, and more particularly concerns a glove which is specially designed for catching and handling a football.

BACKGROUND OF THE INVENTION

Gloves of various designs have long been used in various sports to improve performance. The various performance-enhancing aspects which these gloves offer include providing a better grip on a baseball bat or golf club, for support, such as in bowling, and for gripping a ball, in basketball and football. Such gloves are typically made from leather, although some gloves have special fabric accents in the palm area.

U.S. Pat. No. 5,500,956 to Shulkin et al shows an athletic glove for basketball which has friction elements in the hand area, with the finger portions being removed. U.S. Pat. No. 1,179,871 to St.John shows a conventional glove with palm and finger areas of a rubberized composition. U.S. Pat. No. 5,511,248 to Widdemer teaches a glove having a non-slip characteristic. U.S. Pat. No. 4,598,429 to Mulvaney shows a glove with a partially detackified palm surface.

Also, gloves are made for particular weather conditions, including water-proof, breathable gloves, such as shown in U.S. Pat. No. 5,682,613 to Dinatale.

Each of the above gloves has been developed to solve a somewhat specialized problem or for use in a particular sport or game. The present invention is a football glove.

Football gloves typically are directed toward improving particular aspects of a player's performance, including improvement in catching as well as control of the ball. For the game of football, it is desirable that gloves be water-resistant, since football is often played in inclement weather, but also breathable, so that perspiration will not accumulate inside the glove. Further, the gloves must be easy to wash and otherwise care for. In the past, applicant has experimented with rubberized gloves, including some with a stretchable fabric back portion, but none of those gloves has proven to be completely satisfactory.

DISCLOSURE OF THE INVENTION

Accordingly, the present invention is a glove for catching and handling a football, comprising: a glove body which has a first region which includes approximately a front half of the glove, including at least a front half of the fingers the palm area, and all of the thumb, the first region being made of a material having an exterior surface which is flexible, stretchable, waterproof and sufficiently soft to improve the ease of catching and handling a football, wherein the glove body has a second region which includes approximately a rear half of the glove, including at least a back portion of the hand, the second region being made of a material which is stretchable and breathable.

BEST MODE FOR CARRYING OUT THE INVENTION

Figure 1:
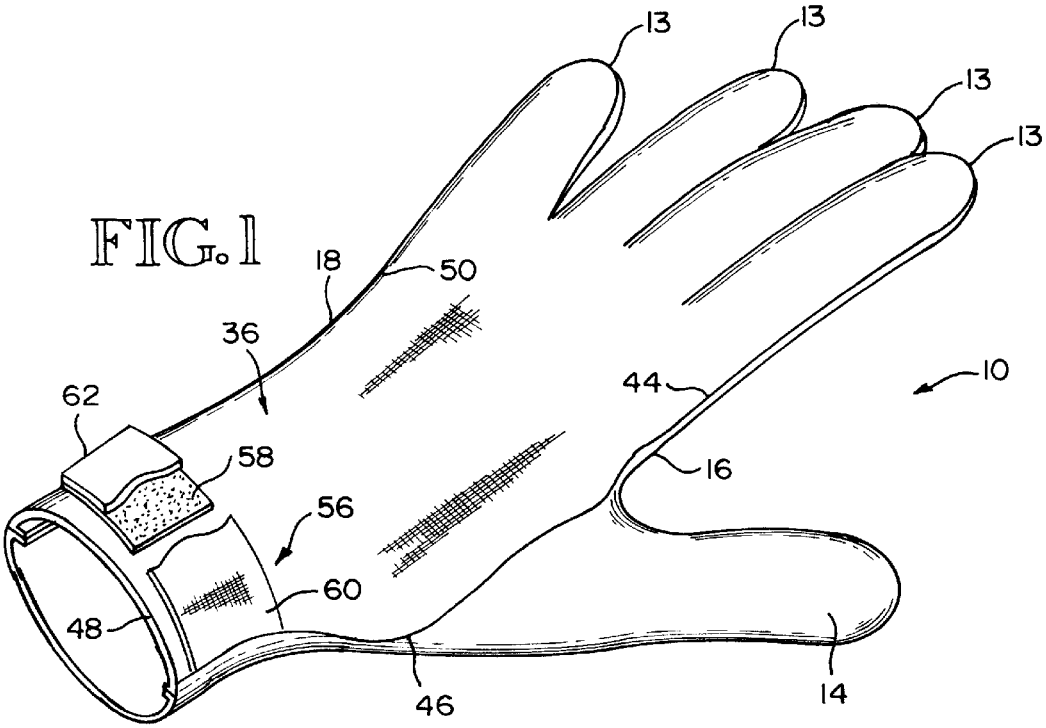
FIG. 1 is a rear perspective view of a first embodiment of a football glove of the present invention.

A first embodiment of the football glove of the present invention is shown generally at 10 in FIGS. 1–4. The glove 10 has two portions, a front portion 12 which extends over approximately the front half of each of the four fingers 13—13 of the glove, around the entire thumb area 14 and the base of the thumb, as well as over the area of the palm 15, the side edges 16, 18 of the hand, and the front part of the wrist 20. The configuration of the front portion 12 is such that it curves slightly around the edges of the hand and the wrist region.

The material comprising the front portion 12 of the glove is quite important, as it must have several specific characteristics. The material must be generally quite soft, flexible and stretchable, so that it bends readily along with the hands as they bend and move. The material should follow the hand as it moves. The material should also be waterproof i.e. it should not absorb water. Further, it is advantageous if the material is slightly textured and somewhat "tacky", so that there is a noticeable roughness, with some adhesion quality, to surface 30 of front portion 12. These characteristics produce a significant improvement in the catching and handling performance of the user, while also providing protection against inclement weather and playing conditions.

In the embodiment shown, the above characteristics of front portion 12 are accomplished by applying a thin, PVC (polyvinylchloride) layer to a foundation fabric layer, such as cotton. A plasticide such as phthaltae, an addition to the PVC to maintain the designed softness and flexibility to the PVC layer. A commercial example of such a combination is sold under the brand name of Werx-Rite, Model No. 10-105, manufactured by the Ansell Company. That particular glove comprises a thin layer of cotton with a layer of softened PVC (approximately the same thickness) on one side of the cotton layer. This can be done in a number of different ways, including by dipping. Other materials could be used, however, including certain rubberized compositions and eurethane compositions, as long as they possess the required characteristics.

A rear portion of the glove, referred to at 36, is joined around its periphery to front portion 12 of the glove by sewing or the like to form a complete glove. Rear portion 36 in the embodiment of FIGS. 1–4 covers generally the rear half fingers 13—13, as well as the back of the hand and wrist. It does not cover, however, any portion of the thumb or the base of the thumb. A seam or joining line 44 of the two portions at one edge of the glove extends from the very tip of the first (index) finger approximately straight down past the thumb to the edge of the wrist at 46, and then further downwardly to lower edge 48 of the glove. The opposing seam line 50, at the other edge of the glove, extends approximately straight from the tip of the little finger to the lower edge 48 of the glove.

The material comprising the rear portion 36 of the glove is stretchable and breathable, allowing internal moisture, such as perspiration, to escape from the glove and reducing the internal temperature, such that the hand will generally stay dry. One fabric which meets such criteria is Lycra®, manufactured by the Dupont Company. Other fabrics, having the same characteristics, can be used. One advantage to a stretchable rear portion is that the glove can be more form-fitting to the contours of the hand, which is not possible with an entirely rubberized glove. In the embodiment shown, the rear portion thus not only adds to the overall attractiveness of the glove, but its performance as well, since the resulting glove conforms to the contours and the movement of the hand, while allowing the glove to breathe, permitting perspiration to evaporate.

The two portions 12 and 36 of the glove are, in the embodiment shown, sewn together by nylon thread. The nylon thread is strong enough to endure the hard use of such a glove in the game of football. Other means, however, could be used to attach the two portions.

In the vicinity of the lower edge 48 of rear portion 36 of the glove is a tightening strap 56, which consists in the embodiment shown of two portions. A first portion 58 is a Velcro® fabric tab, which is sewn to the rear portion of the glove 36 in the vicinity of seam line 50. In the embodiment shown, this Velcro® tab is ¾" wide by 1 ¾" long. The second portion 60, which is a mating Velcro® fabric section, is attached at one end at seam line 44 and is also ¾" wide but 2 ½" long. The free end 62 of the second portion 60 overlays and mates with the first portion 58. The tightening strap 56, depending upon where the second portion is positioned on the first portion, produces a snug fit for the wrist portion of the glove around the wrist of the user.

In use, the user will simply pull the gloves on over the hands, which requires at least a little effort, since the gloves are rather tight and form-fitting. Once the gloves are all the way on, the wrist portion is tightened by use of the tightening strap 56. The glove can be used regardless of weather and field conditions, since the front portion is waterproof. The front portion is the primary surface for catching the ball. Further, the construction of the glove enables it to breathe and to permit escape of perspiration. The relatively soft, flexible characteristics of the front portion can improve the receiver's ability to catch the ball. Other players, even those on defense, will also experience improvement in their ability to handle the ball and to tackle opposing players. Further, the glove can be easily taken off and washed in a clothes washer. The present glove construction can readily tolerate repeated washings. Washing will clean the surface of the glove of any dirt which may accumulate during the game. Conventional leather gloves, on the other hand, will deteriorate rapidly with repeated washings. The present glove thus provides enhanced performance over existing football gloves, yet is convenient to use and easy to care for.

Figure 5:
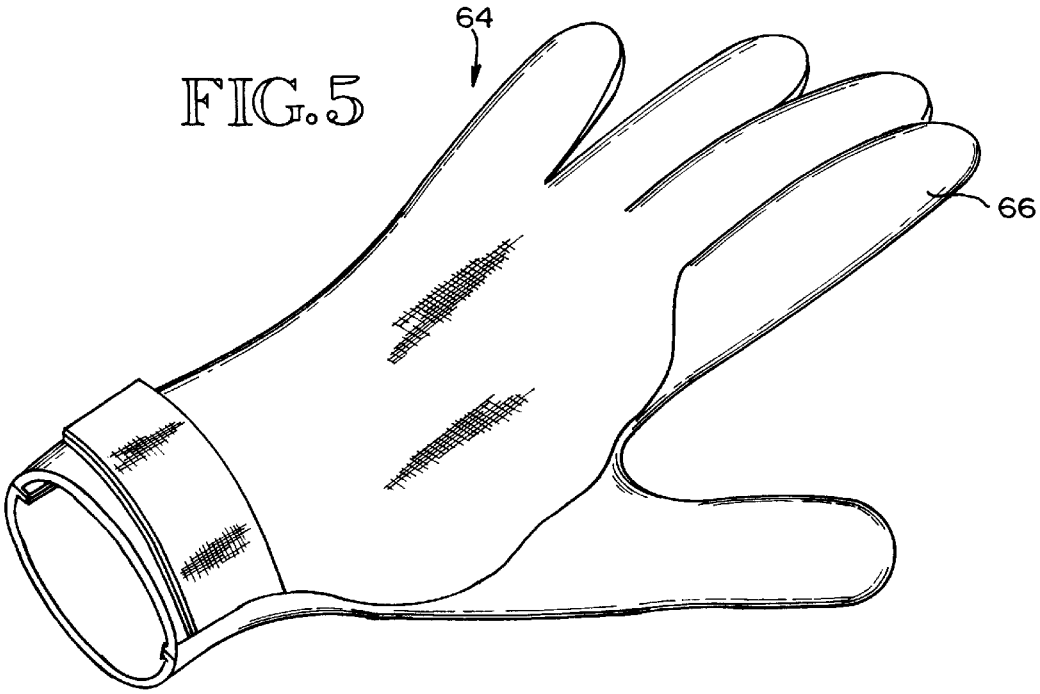
FIG. 5 is a perspective view of a second embodiment of the football glove of the present invention.
Figure 2:
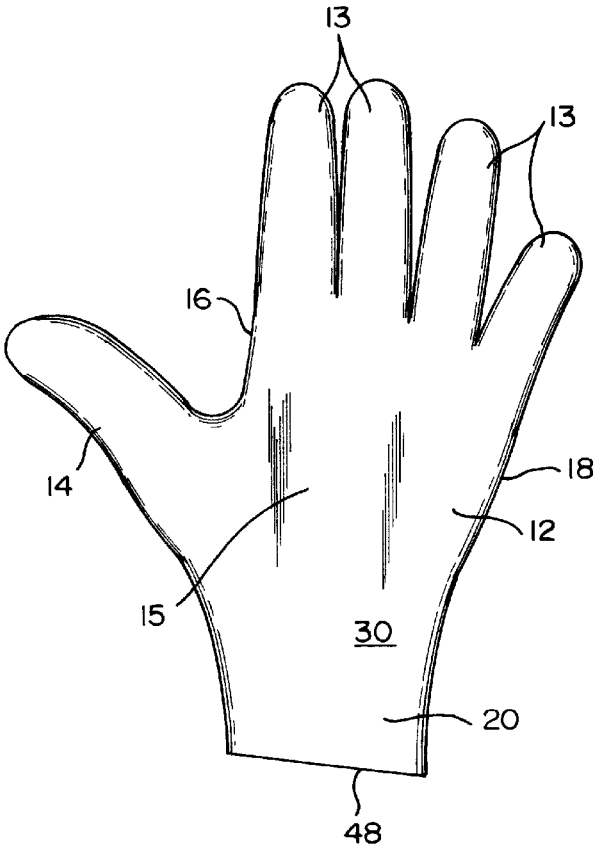
FIG. 2 is a front view of the first embodiment.
Figure 3:
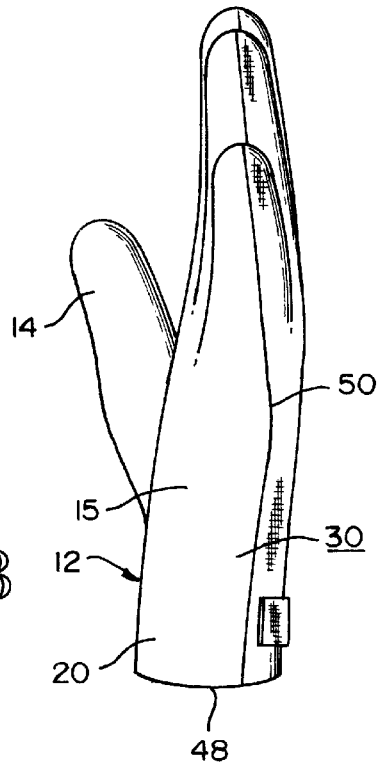
FIG. 3 is a side view of the first embodiment.
Figure 4:
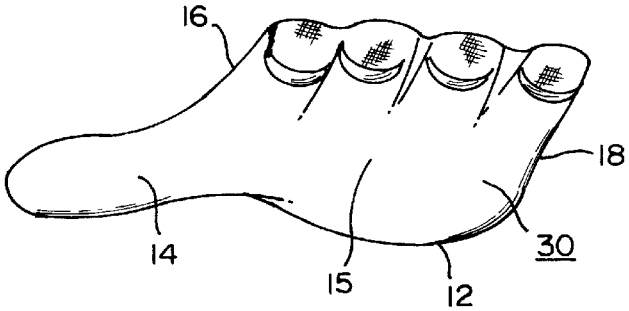
FIG. 4 is an end view of the first embodiment.

FIG. 5 shows a second embodiment of the present invention. In the second embodiment, the glove 64 is identical to that of FIGS. 1 and 2, except that the first finger 66 is entirely (instead of half) of the same material as the first portion 12 of FIGS. 1–4, i.e. a cotton or similar material with a layer of softened PVC (or similar) material. It is thus like the thumb. This has the advantage of possible further improvement in the user's ability to catch a football, since the thumb and index finger are the two main digits used to catch a football. Otherwise, the two gloves are the same.

Figure 6:
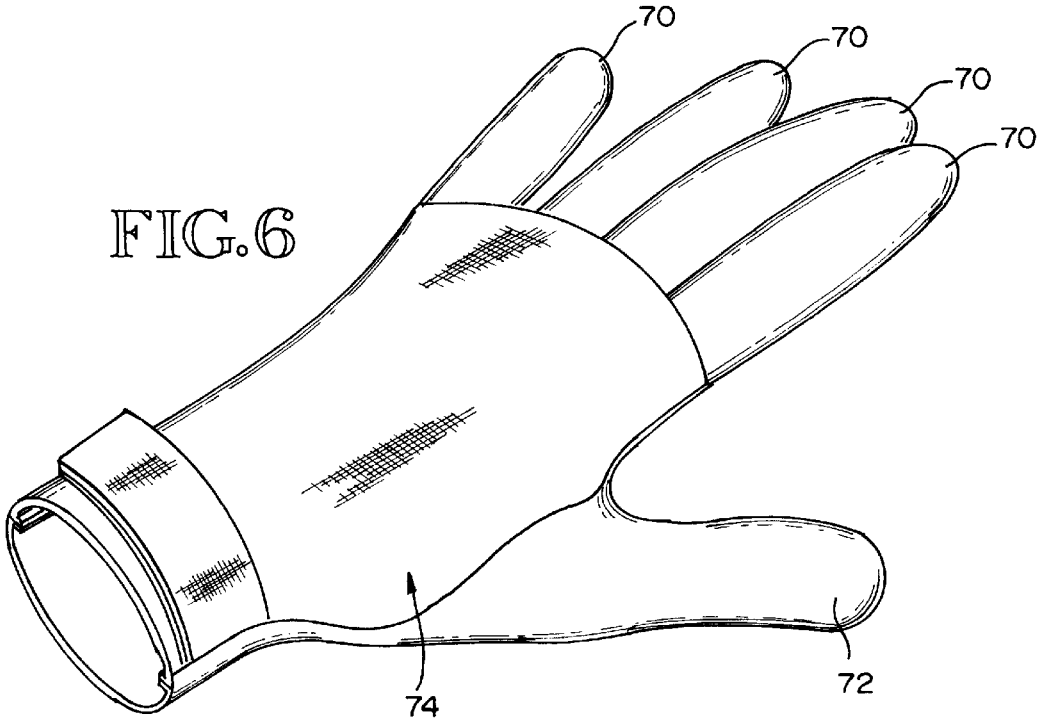
FIG. 6 is a rear perspective view of a third embodiment of the present invention.
Figure 7:
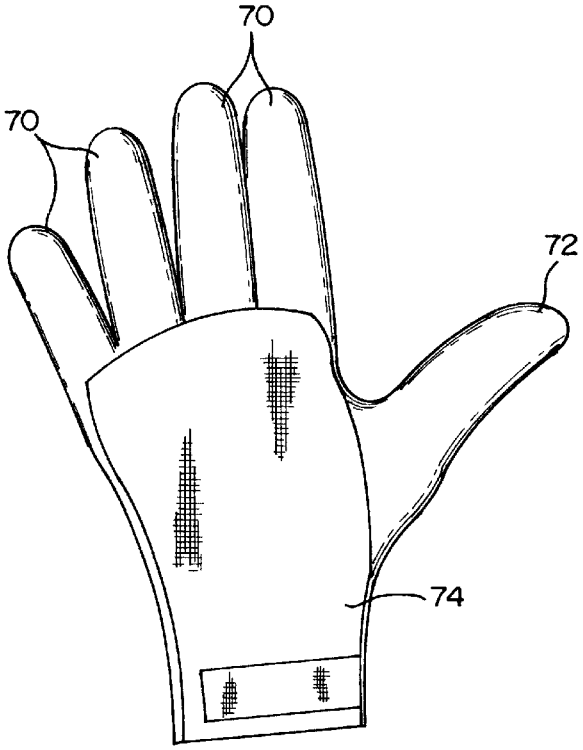
FIG. 7 is a rear view of the third embodiment.
Figure 8:
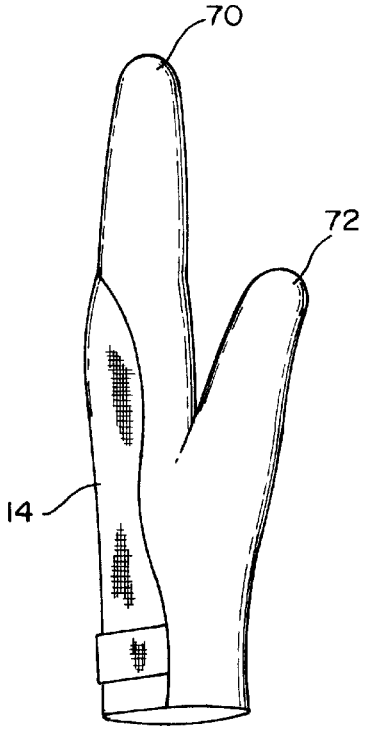
FIG. 8 is a side view of the third.

FIGS. 6–8 show a third embodiment of the present invention. In the third embodiment, all of the fingers 70—70, in addition to the thumb 72, are entirely of the front portion material. In this embodiment, back portion 74 has an upper edge which extends across the glove at the base of the back of the fingers. Otherwise, the construction and arrangement of the glove remains the same as for the embodiment of FIGS. 1–4 and 5.

Hence, a sporting glove particularly designed and adapted for the game of football has been described. The glove includes several structural features which result in a number of advantages over existing gloves.

Although a preferred embodiment of the invention has been disclosed herein for illustration, it should be understood that various changes, modifications and substitutions may be incorporated in such embodiment without departing from the spirit of the invention, which is defined by the claims as follows:

What is claimed is:

1. A glove for catching and handling a football, comprising:

a glove body having a first region which includes approximately a front half of the glove, including at least a front half of the fingers, the palm area and all of the thumb, the first region being made of a material comprising a natural fiber base fabric layer to which has been applied a thin, softened PVC layer, the material having an exterior surface which is flexible, stretchable, waterproof, at most slightly textured and sufficiently soft to improve catching and handling a football and sufficiently elastic, pliable and thin that it tightly conforms to the user's hand and continues to so conform to the user's hand as the hand is moved and flexed so as to provide touch sensitivity for the user when the user is attempting to catch and handle a football;

the glove body having a second region which includes approximately a rear half of the glove, including at least a back portion of the hand, the second region being made of a man-made material which is stretchable and breathable and non-waterproof to the extent that moisture on a user's hand will evaporate through the second region of the glove body, preventing accumulation of perspiration inside the glove.

2. An article of claim 1, including means at a lower edge of the glove body for tightening the lower end of the glove against a wrist of the user.

3. An article of claim 2, wherein the tightening means includes two strap sections which are secured to the second region near the opposing edges thereof, wherein contact between the second portion and the first portion results in mating thereof and a tightening of the lower end of the glove, depending upon the overlap between the first and second portions.

4. An article of claim 1, wherein the first and second regions of the glove body are secured together by sewing.

5. An article of claim 1, wherein the second region includes a rear half of at least three of the fingers.

6. An article of claim 6, wherein a forefinger portion of the glove body is completely comprised of the material of the first region.

7. An article of claim 1, wherein all four fingers are completely comprised of the material of the first region.

* * * * *